US011852385B2

(12) United States Patent
Welch et al.

(10) Patent No.: US 11,852,385 B2
(45) Date of Patent: Dec. 26, 2023

(54) OPEN CYCLE COOLING SYSTEM

(71) Applicant: Copeland LP, Sidney, OH (US)

(72) Inventors: Andrew M. Welch, Franklin, OH (US); Brian R. Butler, Sidney, OH (US)

(73) Assignee: Copeland LP, Sidney, OH (US)

( * ) Notice: Subject to any disclaimer, the term of this patent is extended or adjusted under 35 U.S.C. 154(b) by 62 days.

(21) Appl. No.: 17/402,250

(22) Filed: Aug. 13, 2021

(65) Prior Publication Data

US 2023/0049558 A1 Feb. 16, 2023

(51) Int. Cl.
*F25B 1/10* (2006.01)

(52) U.S. Cl.
CPC ..... *F25B 1/10* (2013.01)

(58) Field of Classification Search
CPC .. F25B 1/10; F25B 19/00; F25B 19/04; F25B 19/005
See application file for complete search history.

(56) References Cited

U.S. PATENT DOCUMENTS

| | | | | |
|---|---|---|---|---|
| 3,404,537 | A * | 10/1968 | Leonard, Jr. | F25B 27/00 203/25 |
| 4,417,451 | A * | 11/1983 | Spauschus | F25B 49/005 62/85 |
| 6,786,059 | B1 | 9/2004 | Piao et al. | |
| 2016/0153729 | A1* | 6/2016 | Andres | F28F 13/00 165/104.31 |
| 2017/0009775 | A1* | 1/2017 | Arnou | F04D 17/122 |
| 2017/0074553 | A1 | 3/2017 | Dinnage | |

FOREIGN PATENT DOCUMENTS

| | | | |
|---|---|---|---|
| GB | 2544473 | A | 5/2017 |
| JP | 2003-014331 | A | 1/2003 |
| JP | 2003185289 | A | 7/2003 |

OTHER PUBLICATIONS

Escudier, M., & Atkins, T. (2019). superheated vapour. In A Dictionary of Mechanical Engineering. : Oxford University Press. Retrieved Aug. 4, 2023, from https://www.oxfordreference.com/view/10.1093/acref/9780198832102.001.0001/acref-9780198832102-e-6379. (Year: 2019).*

(Continued)

*Primary Examiner* — Miguel A Diaz
(74) *Attorney, Agent, or Firm* — Harness, Dickey & Pierce, P.L.C.

(57) ABSTRACT

A cooling system that may include a source of liquid natural refrigerant, a heat exchanger in communication with the source of liquid natural refrigerant that is configured to convert the liquid natural refrigerant into a gaseous natural refrigerant, a compressor in communication with the heat exchanger and configured to increase a temperature and pressure of the gaseous natural refrigerant received from the heat exchanger, and an exhaust device in communication with the compressor and configured to expel the gaseous natural refrigerant received from the compressor to air of an external ambient environment. The exhaust device includes a membrane that permits the gaseous natural refrigerant to exit the exhaust device while preventing or at least minimizing the air of the external ambient environment from entering the exhaust device.

18 Claims, 6 Drawing Sheets

(56) References Cited

OTHER PUBLICATIONS

Escudier, M., & Atkins, T. (2019). latent heat. In A Dictionary of Mechanical Engineering. : Oxford University Press. Retrieved Aug. 4, 2023, from https://www.oxfordreference.com/view/10.1093/acref/9780198832102.001.0001/acref-9780198832102-e-3472. (Year: 2019).*

Escudier, M., & Atkins, T. (2019). sensible enthalpy. In A Dictionary of Mechanical Engineering. : Oxford University Press. Retrieved Aug. 4, 2023, from https://www.oxfordreference.com/view/10.1093/acref/9780198832102.001.0001/acref-9780198832102-e-5527. (Year: 2019).*

International Search Report regarding Application No. PCT/US2022/035129 dated Oct. 18, 2022.

Written Opinion of the ISA regarding Application No. PCT/CN2022/035129 dated Oct. 18, 2022.

Jalaluddin et al., Development of an open-loop ground source cooling system for space air conditioning system in hot climate like Indonesia, MATEC Web Conference, vol. 204, 2018, IMIEC 2018, 6 pages.

* cited by examiner

PRIOR
ART

OPEN CYCLE COOLING SYSTEM

FIELD

The present disclosure relates to an open cycle cooling system.

BACKGROUND

This section provides background information related to the present disclosure which is not necessarily prior art.

The heating, ventilation, air conditioning, and refrigeration (HVAC/R) industry has been making attempts to use natural refrigerants that do not increase carbon dioxide ($CO_2$) emissions. In addition, various regulations are now focusing on eliminating per- and poly-fluoroalkyl substances (PFAS) as refrigerants, which creates an incentive to find natural solutions for use as refrigerants. Thus, it would be desirable to develop an HVAC/R system that uses a natural refrigerant. These same HVAC/R systems move heat from a low temperature source to a high temperature sink where the sink is the outdoor ambient dry bulb or wet bulb temperature for cooling systems. It is also desirable to reject the heat removed from the source at a lower effective temperature, such as the dew point temperature of outdoor ambient air to reduce the head and power on the compressor of the HVAC/R system.

SUMMARY

This section provides a general summary of the disclosure and is not a comprehensive disclosure of its full scope or all of its features.

According to a first aspect of the present disclosure, there is provided a cooling system that may include a source of liquid natural refrigerant; a heat exchanger in communication with the source of liquid natural refrigerant that is configured to convert the liquid natural refrigerant into a gaseous natural refrigerant; a compressor in communication with the heat exchanger and configured to increase a temperature and pressure of the gaseous natural refrigerant received from the heat exchanger; and an exhaust device in communication with the compressor and configured to expel the gaseous natural refrigerant received from the compressor to air of an external ambient environment, wherein the exhaust device includes a membrane that permits the gaseous natural refrigerant to exit the exhaust device while preventing or at least minimizing the air of the external ambient environment from entering the exhaust device.

According to the first aspect, the natural refrigerant may be water.

According to the first aspect, the system may also include a valve between the source of liquid natural refrigerant and the heat exchanger that meters an amount of the liquid natural refrigerant permitted to enter the heat exchanger.

According to the first aspect, the amount of liquid natural refrigerant permitted to enter the heat exchanger is equal to the amount of liquid natural refrigerant that is converted the gaseous natural refrigerant by the heat exchanger.

According to the first aspect, the system may also include an accumulator between the heat exchanger and the compressor.

According to the first aspect, the gaseous natural refrigerant in the accumulator that condenses into the liquid natural refrigerant is communicated from the accumulator back to the source of liquid natural refrigerant.

According to the first aspect, the compressor may comprise a multi-stage radial, mixed-flow, or axial centrifugal compressor.

According to the first aspect, the membrane includes a plurality of pores that permit the gaseous natural refrigerant to exit the exhaust device while preventing or at least minimizing the air of the external ambient environment from entering the exhaust device.

According to the first aspect, the pores are sized to be less than a molecular size of nitrogen gas.

According to the first aspect, the membrane is formed of a polymeric material.

According to a second aspect of the present disclosure, there is provided a cooling method that may include metering a liquid natural refrigerant to a heat exchanger that converts the liquid natural refrigerant into a gaseous natural refrigerant; increasing a temperature and pressure of the gaseous natural refrigerant; and expelling the gaseous natural refrigerant having the increased temperature and pressure to air of an external ambient environment through a membrane that permits the gaseous natural refrigerant to pass therethrough while preventing or at least minimizing the air of the external ambient environment from passing through the membrane.

According to the second aspect, the natural refrigerant may be water.

According to the second aspect, the metering may include controlling an amount of the liquid natural refrigerant permitted to enter the heat exchanger such that the amount of liquid natural refrigerant permitted to enter the heat exchanger is equal to the amount of liquid natural refrigerant that is converted the gaseous natural refrigerant by the heat exchanger.

According to the second aspect, increasing the temperature and pressure of the gaseous natural refrigerant may be done by passing the gaseous natural refrigerant through a compressor.

According to the second aspect, the compressor may comprise a multi-stage radial, mixed-flow, or axial centrifugal compressor.

According to the second aspect, the membrane includes a plurality of pores that permit the gaseous natural refrigerant to pass through the membrane while preventing or at least minimizing the air of the external ambient environment from passing through the membrane.

According to the second aspect, the pores are sized to be less than a molecular size of nitrogen gas.

According to the second aspect, the membrane may be formed of a polymeric material.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
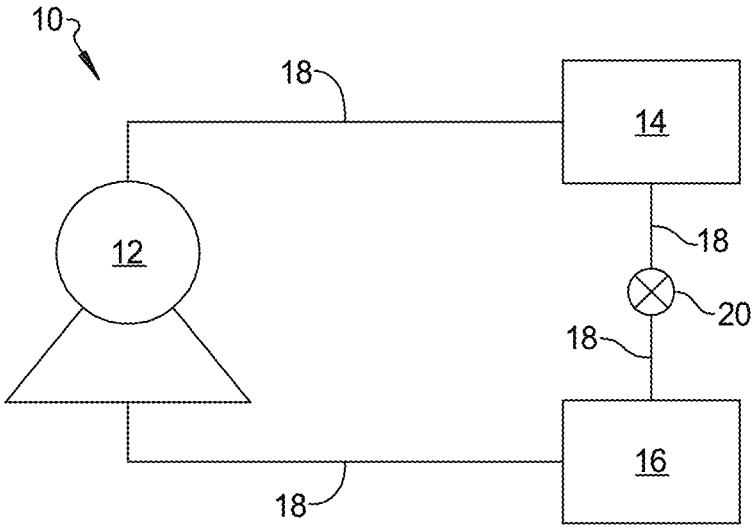
FIG. 1 is a schematic illustration of a conventional HVAC system.

Referring to FIG. 1, a conventional HVAC/R system 10 is illustrated. System 10 may generally include a compressor 12, a condenser 14, and an evaporator 16 that are connected by connection lines 18. Disposed between condenser 14 and evaporator 16 may be an expansion device 20 such as a valve or capillary tube. Compressor 12 is configured to receive low-pressure refrigerant from evaporator 16 through one of the connection lines 18 at a suction side and dispense high-pressure refrigerant at a discharge side through another of the connection lines 18 to the condenser 14. Thus, system 10 is a closed-loop system.

During refrigeration, system 10 uses the cooling effect of evaporation of the refrigerant to lower the temperature of the surroundings near one heat exchanger (i.e., evaporator 16) and uses the heating effect of high pressure, high temperature gas to raise the temperature of the surroundings near another heat exchanger (i.e., condenser 14). This is usually accomplished by releasing a refrigerant under pressure (usually in a liquid phase) into a low-pressure region to cause the refrigerant to expand into a low temperature mixture of liquid and vapor. Commonly, this low-pressure region comprises a coil (not shown) that forms part of evaporator 16. Once in the coil of the evaporator 16, the refrigerant mixture may exchange heat with a tubing of the coil, which in turn exchanges heat with higher temperature ambient air of the region desired to be cooled. Evaporation of refrigerant from liquid to gas absorbs heat from the ambient air and thereby cools it. Typically, the refrigerant may be a synthetic substance that may also be a PFAS.

Figure 2:
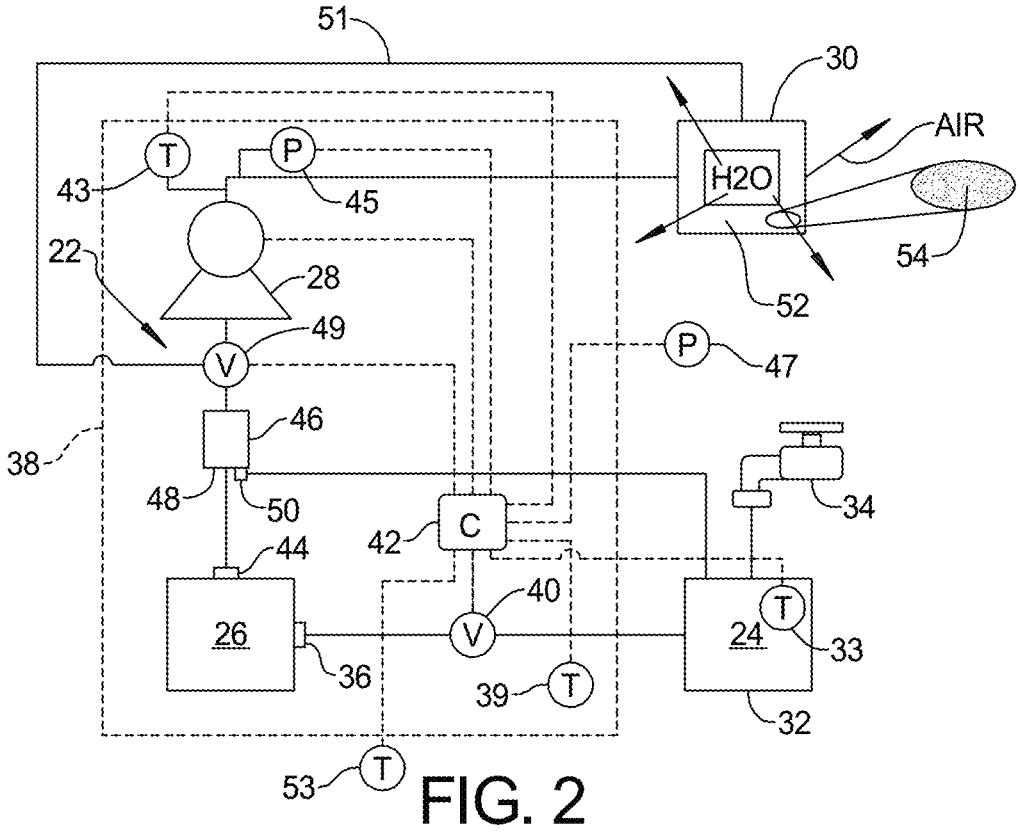
FIG. 2 is a schematic illustration of an HVAC system according to a principle of the present disclosure.

Now referring to FIG. 2, a schematic example of a cooling system 22 according to a principle of the present disclosure is illustrated. In the illustrated example, cooling system 22 is an open system (i.e., not closed-loop), and is a system that uses a natural refrigerant. Example natural refrigerants include water, ammonia, hydrocarbons, and the like. Cooling system 22 includes a natural refrigerant source 24, a heat exchanger 26 (i.e., evaporator) configured for receipt of the natural refrigerant from the natural refrigerant source 24, a compressor 28 in fluid communication with the heat exchanger 26, and an exhaust device 30 that emits the natural refrigerant to the ambient environment. Because the natural refrigerant is emitted to the ambient environment, the system 22 is an open system. In addition, because the natural refrigerant is emitted to the ambient environment, it is desirable that the natural refrigerant be one that does not increase carbon emissions or may be harmful to the environment. Thus, according to the present disclosure, the cooling system 22 may use water as the natural refrigerant. It should be understood, however, that other natural refrigerants may be used without departing from the scope of the present disclosure.

When the refrigerant is water, natural refrigerant source 24 may be a tank 32 that is in communication with a source of water such as a tap 34. Alternatively, tap 34 may be in direct fluid communication with heat exchanger 26, or tank 32 may be configured for receipt of rainwater. Other potential sources of water include reclaimed grey water, chemically-treated or untreated water, seawater, a mixture of fresh water and reclaimed grey water, or a mixture of fresh water and chemically-treated or untreated water. If grey water or seawater is used, it may be filtered before permitted to enter heat exchanger 26. A temperature of the refrigerant in tank 32 may be monitored by a temperature sensor 33 located therein or located exterior to tank 32. In any event, the water is provided to an inlet 36 of heat exchanger 26, which may be any type of heat exchanger known to one skilled in the art. For example, heat exchanger 26 may be a microchannel liquid-to-gas heat exchanger where the water passes through a plurality of narrow extruded channels connected to finned structures that assist in exchanging heat from the refrigerant to the ambient environment. Inasmuch as the heat exchanger 26 is designed to cool the ambient air surrounding the heat exchanger 26, heat exchanger 26 may be located within a structure 38 or building that is desired to be cooled, either with or without ducting as will be described in more detail later. A temperature within structure 38 may be monitored by a temperature sensor 39.

As the water travels through heat exchanger 26 and exchanges heat with the ambient air, the water will evaporate. The water from refrigerant source 24 may be metered to heat exchanger 26 at the same rate at which the water evaporates within heat exchanger 26. To ensure that the water from refrigerant source 24 is metered at the same rate at which the water evaporates in heat exchanger 26, a valve 40 may be positioned between refrigerant source 24 and heat exchanger inlet 36. Valve 40 may be any type of valve known to one skilled in the art, but is preferably an electronic (e.g., expansion or needle) valve that communicates with a controller 42 that is configured to control the amount of fluid (i.e., refrigerant) that may flow between heat exchanger 26 from refrigerant source 24. Controller 42 may also be in communication with compressor 28 and temperature sensor 39, as illustrated.

As the water evaporates in heat exchanger 26, the evaporated water (i.e., water vapor) may exit heat exchanger 26 through a heat exchanger outlet 44. Heat exchanger outlet 44 is in fluid communication with compressor 28. Alternatively, heat exchanger outlet 44 may be in fluid communication with an accumulator 46 positioned between heat exchanger outlet 44 and compressor 28. If an accumulator 46 is used, a portion of the water vapor that enters the accumulator 46 may condense and collect at a bottom 48 of accumulator 46. Thus, accumulator 46 may include a fluid egress port 50 that communicates with refrigerant source 24. Regardless of whether system 22 includes accumulator 46, the water vapor exits heat exchanger 26 and travels to compressor 28.

Compressor 28 may be any type of compressor known to one skilled in the art. Preferably, however, compressor 28 may be a multi-stage radial, mixed-flow, or axial centrifugal compressor, which will be described in more detail later. When the outdoor partial pressure of the natural refrigerant is greater than the evaporating pressure of the natural refrigerant, the pressure and temperature of the water vapor is increased by compressor 28, which can be monitored by a temperature sensor 43 and a pressure sensor 45 that each communicate with controller 42. After the pressure and temperature of the water vapor is increased by compressor 28, the greater temperature and pressure water vapor exits compressor 28 and is provided to exhaust device 30. Compressor 28 may be located within structure 38, or may be located exterior from structure 38 (i.e., outdoors in the exterior ambient environment).

It should be understood that when the outdoor partial pressure of the natural refrigerant is less than or equal to the evaporating pressure of the natural refrigerant, the compressor 28 may be unpowered such that the natural refrigerant simply flows through the compressor 28. The outdoor partial pressure of the natural refrigerant may be monitored by another pressure sensor 47 located exterior to structure 38. Alternatively, when the outdoor partial pressure of the natural refrigerant is less than or equal to the evaporating pressure of the natural refrigerant, the natural refrigerant may bypass the compressor 28. In such a case, a valve 49 may be located between compressor 28 and heat exchanger 26 that communicates with controller 42. If compressor 28 is to be bypassed, valve 49 may direct the flow of refrigerant to a bypass line 51 that fluidly communicates with exhaust device 30 to avoid compressor 28.

Exhaust device 30 includes a vapor-selective membrane 52 that, upon receipt of the water vapor from compressor 28, permits the water vapor to pass therethrough to the exterior ambient environment at the partial pressure of the natural refrigerant in the ambient environment. Vapor selective membrane 52 may be formed from a polymeric material 54 or a natural material such as a zeolite where pores of the membrane 52 are sized to be less than a molecular size of nitrogen gas ($N_2$). Because the pores of membrane 52 are sized to be less than a molecular size of nitrogen gas, the ambient air is prevented, or at least substantially prevented, from entering exhaust device 30 and only the water vapor located in exhaust device 30 is permitted to be exhausted to the exterior ambient environment. Details of an example configuration for exhaust device 30 will be described in more detail later.

In the following example of using system 22 to cool structure 38, the exterior ambient conditions are that the dry bulb temperature is about 35 degrees C. (95 degrees F.), the wet bulb temperature is about 23.9 degrees C. (75 degrees F.), and the dew point temperature is about 19.4 degrees C. (67 degrees F.). These temperatures may be monitored by a temperature sensor 53 located exterior to structure 38, as illustrated in FIG. 2. The indoor ambient conditions are about 26.6 degrees C. (80 degrees F.) with a desire to cool to a temperature of about 18.3 degrees C. (65 degrees F.); and the temperature of the water refrigerant at the refrigerant source 24 is about 4.4 degrees C. (40 degrees F.). As the water refrigerant enters heat exchanger 26, the pressure of the liquid water may be at, for example, about 0.12 psia. As the water refrigerant travels through heat exchanger 26, the liquid water will undergo phase change to water vapor. Notwithstanding this phase change, the water vapor may exit heat exchanger 26 at the same temperature and pressure as when the liquid water entered the heat exchanger 26 (i.e., the saturation temperature will remain about 4.4 degrees C. (40 degrees F.) and at about 0.12 psia). The water vapor will then undergo an increase in saturation temperature and pressure as water vapor is pumped through compressor 28 such that the saturation temperature of the water vapor will be about 24.4 degrees C. (76 degrees F.) and the pressure will be about 0.38 psia. The increased temperature water vapor will then travel from compressor 28 to exhaust device 30, where the increased temperature water vapor may exit system 22 by passing through membrane 52 to the exterior ambient environment. Because the water refrigerant is increased to a temperature that is greater than the dew point, system 22 is able to reduce the temperature within structure or building 38. The above example is for example purposes only, and it should be understood that different temperatures and pressures are contemplated. The primary aspect to keep in mind is that the refrigerant should be at a temperature that is greater than the dew point of the exterior ambient environment to ensure that cooling may take place within structure 38 to be cooled, which enables the water vapor to exit exhaust device 30 at the partial pressure of the natural refrigerant vapor in the exterior ambient air (i.e., at the saturation of the dew point temperature when the natural refrigerant is water).

Figure 3:
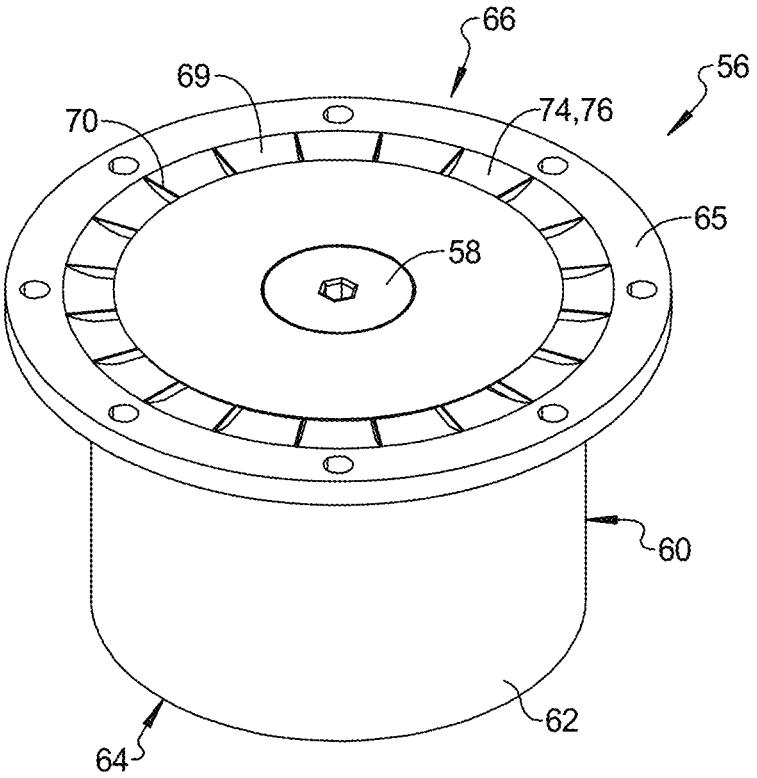
FIG. 3 is a perspective view of a compression mechanism that can be used in the system illustrated in FIG. 2.
Figure 4:
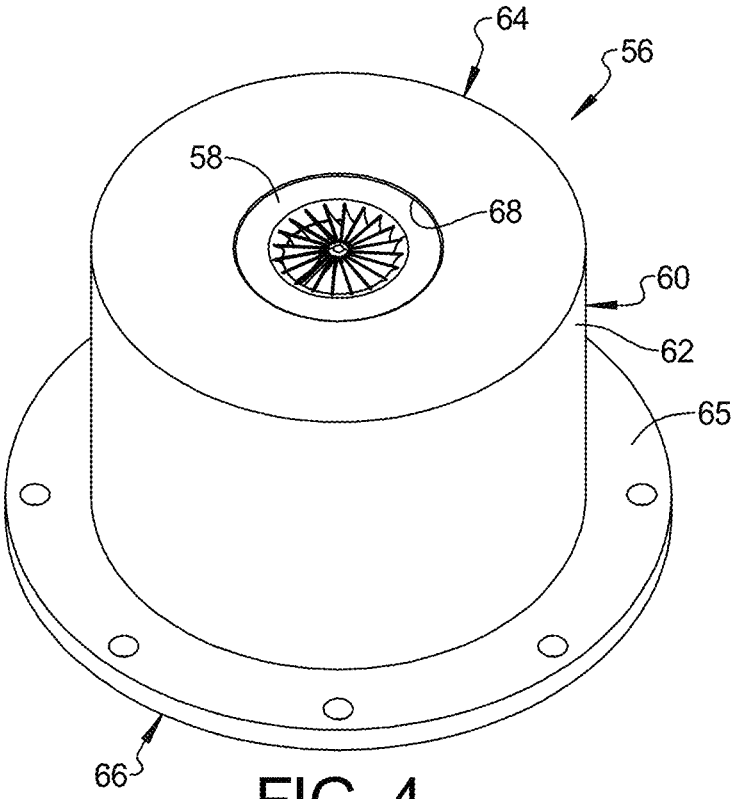
FIG. 4 is another perspective view of the compression mechanism that can be used in the system illustrated in FIG. 2.
Figure 5:
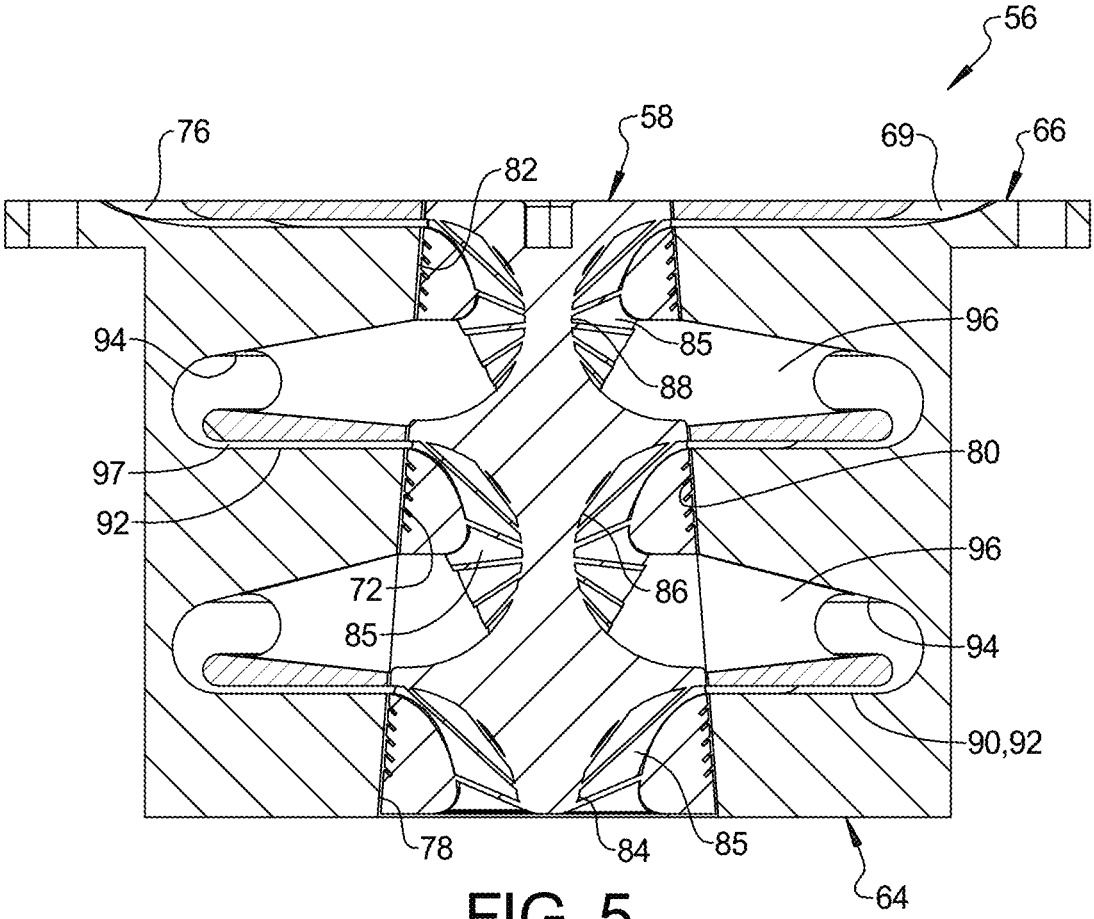
FIG. 5 is a cross-sectional view of the compression mechanism illustrated in FIGS. 3 and 4.

Now referring to FIGS. 3-5, an example compression mechanism 56 that may be part of compressor 28 is illustrated. In the illustrated embodiment, compression mechanism 56 is a multi-stage radial centrifugal compression mechanism. Although different types of compressors are contemplated (e.g., scroll or reciprocating compressors) this type of compression mechanism is preferable due to the natural refrigerant in vapor form being much less dense in comparison to a synthetic refrigerant such as R410A. Due to the density of the water vapor being much less in comparison to a synthetic refrigerant such as R410A, the dimensions of a positive displacement compressor such as, for example, a scroll compressor would require the dimensions of the scroll compressor to be significantly larger than those currently in use, which may be impractical. Moreover, the illustrated compression mechanism 56 may be molded from a polymeric material that is compatible with water that will not corrode. Although not illustrated, it should be understood that compression mechanism 56 is functionally attached to a shell (not illustrated) of the compressor 28 that includes an electric motor (e.g., rotor and stator, not illustrated) that rotates a spindle 58 of compression mechanism 56. In addition, although not illustrated, it should be understood that the compressor 28 may be a mixed-flow or axial centrifugal compressor.

Compression mechanism 56 includes a housing 60 that includes spindle 58 rotatably supported therein. Housing 60 may be a generally cylindrical structure 62 having an inlet end 64, an outlet end 66, and a flange 65 that extends about a periphery of cylindrical structure 62 at outlet end 66. Inlet end 64 includes an inlet 68 that is configured for receipt of the gaseous refrigerant from heat exchanger 26. Outlet end 66 has a dish-shaped recess 69 that includes a plurality of spaced-apart upstanding ribs 70 formed therein. Recess 68 surrounds a frustoconically-shaped bore 72 that extends between inlet end 64 and outlet end 66. Thus, as the compressed gaseous refrigerant exits compression mechanism from bore 72, the gaseous refrigerant will travel through the spaces 74 between ribs 70 such that spaces 74 between ribs 70 serve as outlet ports 76.

Spindle 58 is located in bore 72, which is frustoconically-shaped such that a volume of bore 72 decrease in the direction from inlet end 64 to outlet end 66 such that as the gaseous refrigerant travels through compression mechanism 56, the gaseous refrigerant will be compressed to increase the temperature and pressure of the gaseous refrigerant. Bore 72 includes a first section 78, a second section 80, and a third section 82, and spindle 58 includes an inlet portion 84 positioned within first section 78, an intermediate portion 86 positioned within second section 80, and an outlet portion 88 positioned within third section 82. Each portion 84, 86, and 88 includes a plurality of primary vanes 85 that serve to pump the gaseous refrigerant through compression mechanism 56.

In this regard, as spindle 58 rotates, the gaseous refrigerant will first be pumped by primary vanes 85 of inlet portion 78 in a direction toward a first annular channel 90 that is located radially outward from and in communication with first section 78 of bore 72. First annular channel 90 may include a first portion 92 in communication with first section 78 that extends radially outward from first section 78, and a second portion 94 connected to first portion 92 that extends radially inwardly back toward and in communication with second section 80. Second portion 94 may include plurality of secondary vanes 96 located therein.

Once the gaseous refrigerant has been pumped by inlet portion 78 through first annular channel 90 into second section 80 of bore 72, the primary vanes 85 of intermediate portion 86 of spindle 58 will pump the gaseous refrigerant from second section 80 into a second annular channel 97 that is located radially outward from and in communication with section 80. Similar to first annular channel 90, second annular channel 97 includes a first portion 92 in communication with second section 80 that extends radially outward from second section 80, and a second portion 94 connected to first portion 92 that extends radially inwardly back toward and in communication with third section 82. Third section 82 may also include plurality of the secondary vanes 96 located therein. After reaching third section, the primary vanes 85 of outlet portion 86 will pump the compressed gaseous refrigerant out of outlet ports 76.

Figure 6:
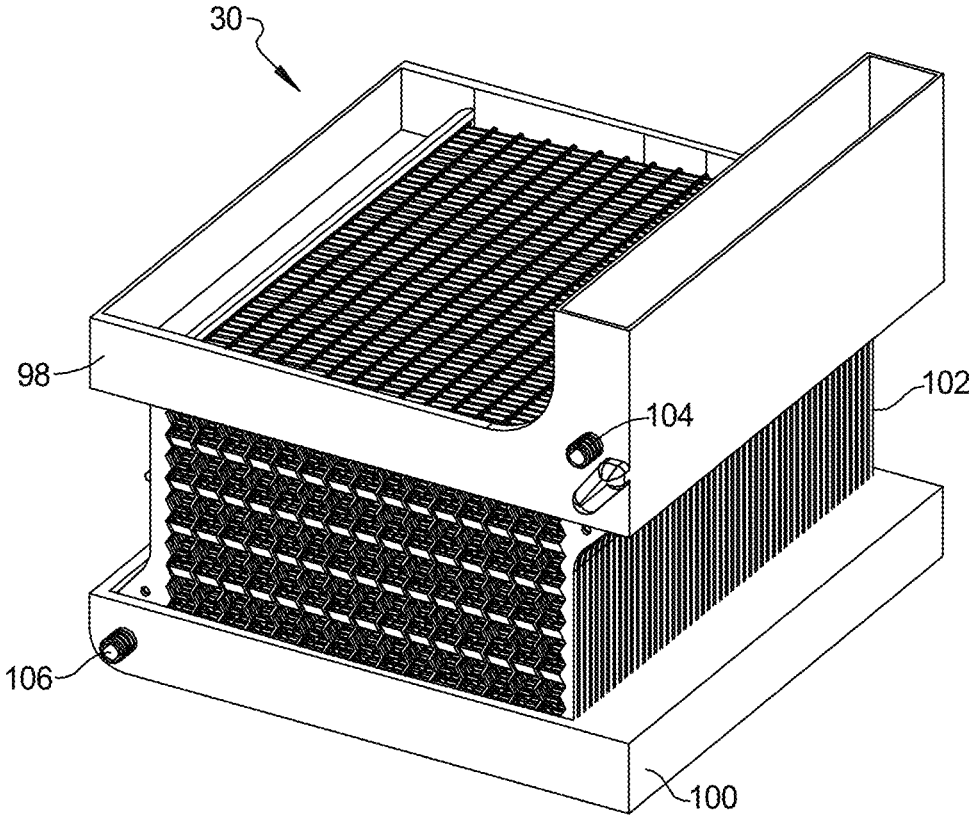
FIG. 6 is a perspective view of an exhaust device that can be used in the system illustrated in FIG. 2.
Figure 7:
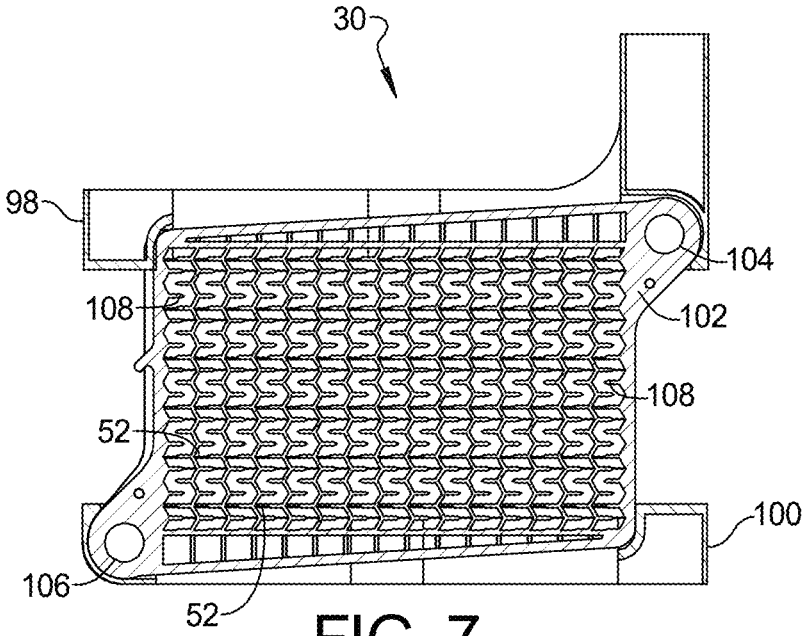
FIG. 7 is a cross-sectional view of the exhaust device illustrated in FIG. 6.

After exiting outlet ports 76, the compressed gaseous natural refrigerant will travel to exhaust device 30. An example exhaust device 30 is illustrated in FIGS. 6 and 7. Exhaust device 30 includes an upper support 98 and a lower support 100 that support a plurality of molded plates 102 and vapor selective membranes 52 therebetween. Upper support 98 includes an inlet 104 and lower support 100 includes an outlet 106.

As best shown in FIG. 7, each molded plate 102 includes a plurality of baffles 108. Baffles 108 create a tortuous path through exhaust device 30. As the compressed gaseous natural refrigerant travels through baffles 108 and membranes 52, the compressed gaseous natural refrigerant will be permitted to exit exhaust device 30 through the pores of vapor-selective membrane 52. If the compressed natural refrigerant condenses while in exhaust device, gravity will carry the condensed liquid natural refrigerant in a direction toward outlet 106 where it may exit exhaust device 30. Alternatively, the outlet 106 may be in communication with refrigerant source 24 via a tube (not illustrated).

While natural refrigerants such as water have been described above, it should be understood that various additives may be added to the refrigerant, if desired. One example additive may be a desiccant such as $CaCl_2$) that is intermixed with the natural refrigerant. In such a case, as the desiccant-carrying refrigerant passes through system 22, the desiccant-carrying refrigerant may not necessarily evaporate in evaporator 26 but simply exchange heat with the indoor ambient environment. If the desiccant evaporates with the natural refrigerant and is compressed within compressor 28, the desiccant will be passed along to exhaust device 30 where its molecules will be too large to pass through the pores of the polymeric material 54 of membrane 52. If the desiccant accumulates in the exhaust device 30, it will raise the pressure leaving compressor 28 further above the partial pressure of the natural refrigerant in the outdoor ambient over time. The desiccant may be periodically removed from the exhaust device 30 by a vacuum pump (not illustrated) connected through outlet port 106.

Figure 8:
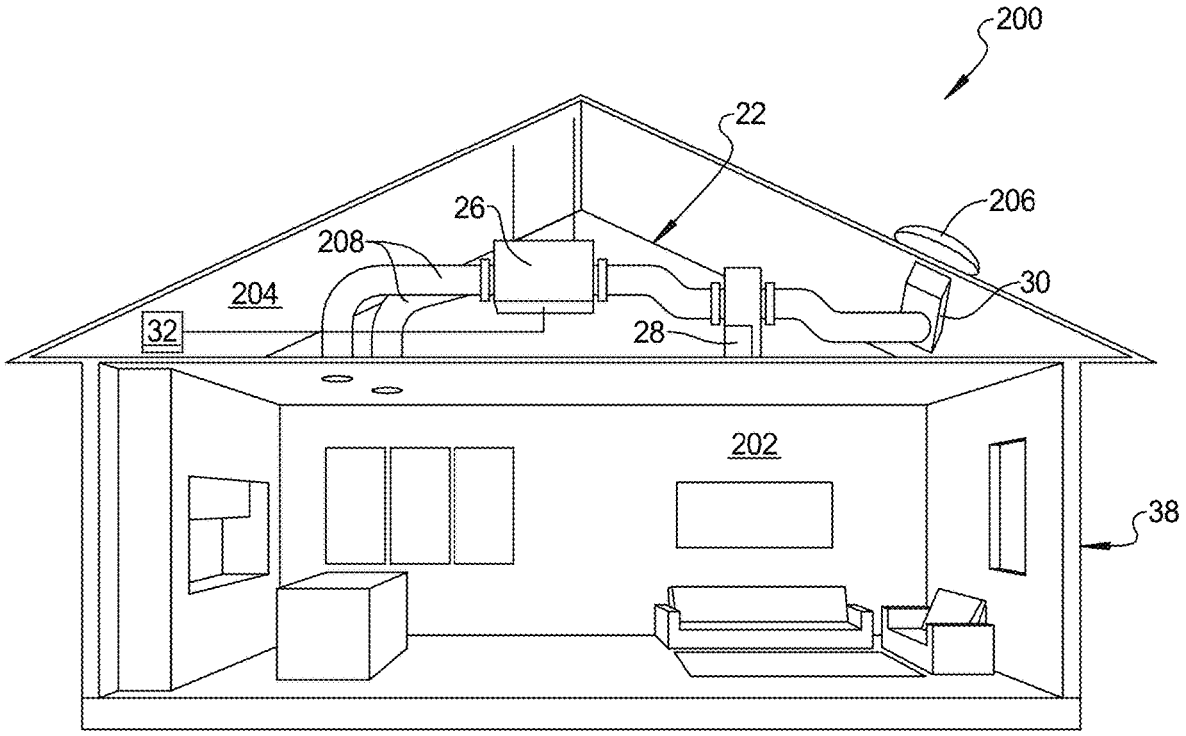
FIG. 8 is a perspective view of the HVAC system according to the present disclosure being employed in a building in a concealed ducted split system.
Figure 9:
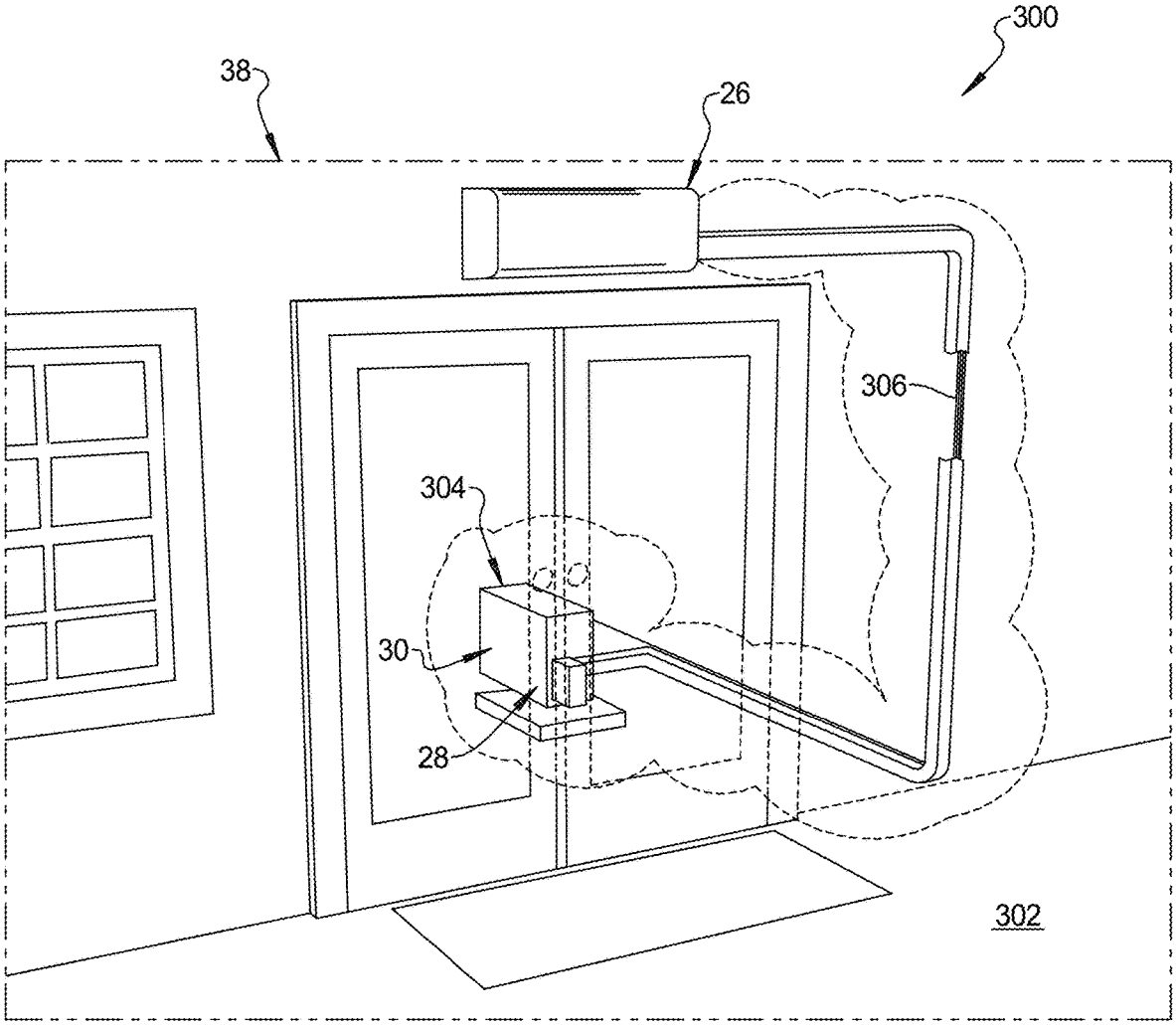
FIG. 9 is a perspective view of the HVAC system according to the present disclosure being employed in a building in a ductless mini-split system.

Now referring to FIGS. 8 and 9, system 22 is illustrated being used in a concealed ducted split system 200 within a building 38 (FIG. 8), and being used in a ductless mini-split system 300 for a building 38 (FIG. 9). Concealed ducted split system 200 may be located in a building 38 having an area 202 to be cooled, and may be concealed in a location such as an attic 204 (illustrated), or may be concealed in location such as a basement (not illustrated), crawl space (not illustrated), or any other location that conceals system 22. As illustrated in FIG. 8, system 22 includes heat exchanger 26, compressor 28, and exhaust device 30 that communicates with the external atmosphere through a vent 206. In addition, ducts 208 communicate the air cooled by heat exchanger 26 to the area 202 to be cooled. Although not illustrated in FIG. 8, it should be understood that a water line (if the natural refrigerant is water) that is in communication with the source of water (not illustrated) to the building 38 may provide the water refrigerant to heat exchanger 26, or a separate tank 32 like that illustrated in FIG. 2 may be used (as illustrated).

Now referring to FIG. 9, the ductless mini-split system 300 will be described. System 300 may be located in a building 38 having an area 302 to be cooled. System 300 includes heat exchanger 26 located within area 302 to be cooled, while each of the compressor 28 and the exhaust device 30 may be located exterior to building 38 in a containment unit 304. As illustrated in FIG. 9, refrigerant lines 306 provide a natural refrigerant such as water to heat exchanger 26, and route the water exiting heat exchanger 26 to compressor 28 and then on to exhaust device 30 where the generated water vapor may communicate to the external atmosphere through vents located in unit 304. One of the refrigerant lines 306 may be in communication with a water line that is in communication with the source of water (not illustrated) to the building 38 that provides water refrigerant to heat exchanger 26, or a separate tank 32 like that illustrated in FIG. 2 may be used (not illustrated).

According to the above disclosure, the indoor air temperature within structure or building 38 can be lowered using a refrigerant that does not utilize a synthetic refrigerant that may include a PFAS. When the natural refrigerant is water, the refrigerant can easily be provided using a water source such as tap 34, or the tank 32 may be configured for receipt of rainwater that may be filtered and used for the refrigerant. System 22 is beneficial in that it may be used to cool the indoor air of structure or building 38 when the outdoor partial pressure partial of the water refrigerant is greater than the evaporating pressure of the water refrigerant, or when the outdoor partial pressure of the water refrigerant is less than or equal to the evaporating pressure of the water refrigerant.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A cooling system, comprising:

a source of liquid natural refrigerant;

a heat exchanger in communication with the source of liquid natural refrigerant that is configured to receive the liquid natural refrigerant at a first temperature and at a first pressure, convert the liquid natural refrigerant into a gaseous natural refrigerant, and discharge the gaseous natural refrigerant at the first temperature and the first pressure;

a compressor in communication with the heat exchanger and configured to increase the first temperature and the first pressure of the gaseous natural refrigerant received from the heat exchanger to a second temperature and a second pressure; and an exhaust device in communication with the compressor and configured to expel the gaseous natural refrigerant received from the compressor to air of an external ambient environment, wherein the exhaust device includes a membrane that permits the gaseous natural refrigerant to exit the exhaust device while preventing or at least minimizing the air of the external ambient environment from entering the exhaust device.

2. The cooling system according to claim 1, wherein the natural refrigerant is water.

3. The cooling system according to claim 1, further comprising a valve between the source of liquid natural refrigerant and the heat exchanger that meters an amount of the liquid natural refrigerant permitted to enter the heat exchanger.

4. The cooling system according to claim 3, wherein the amount of liquid natural refrigerant permitted to enter the heat exchanger is equal to the amount of liquid natural refrigerant that is converted to gaseous natural refrigerant by the heat exchanger.

5. The cooling system according to claim 1, further comprising an accumulator between the heat exchanger and the compressor, wherein the gaseous natural refrigerant in the accumulator that condenses into the liquid natural refrigerant is communicated from the accumulator back to the source of liquid natural refrigerant.

6. The cooling system according to claim 1, wherein the refrigerant is at least one of rain water, seawater, grey water, chemically-treated water, a mixture of water and reclaimed grey water, a mixture of water and chemically-treated water, and combinations thereof.

7. The cooling system according to claim 1, wherein the compressor comprises a multi-stage centrifugal compressor.

8. The cooling system according to claim 1, wherein the membrane includes a plurality of pores that permit the gaseous natural refrigerant to exit the exhaust device while preventing or at least minimizing the air of the external ambient environment from entering the exhaust device.

9. The cooling system according to claim 8, wherein the pores are sized to be less than a molecular size of nitrogen gas.

10. The cooling system according to claim 7, wherein the membrane is formed of a polymeric material.

11. A cooling method, comprising:

metering a liquid natural refrigerant at a first temperature and first pressure to a heat exchanger that converts the liquid natural refrigerant into a gaseous natural refrigerant, the gaseous natural refrigerant that exits the heat exchanger being at the first temperature and the first pressure;

increasing the first temperature and the first pressure of the gaseous natural refrigerant to a second temperature and second pressure, the second temperature of the gaseous natural refrigerant being at or above a dew point of an exterior environment; and expelling the gaseous natural refrigerant having the increased second temperature and second pressure to air of the external ambient environment through a membrane that permits the gaseous natural refrigerant to pass therethrough while preventing or at least minimizing the air of the external ambient environment from passing through the membrane.

12. The cooling method according to claim 11, wherein the natural refrigerant is water.

13. The cooling method according to claim 11, wherein the metering includes controlling an amount of the liquid natural refrigerant permitted to enter the heat exchanger such that the amount of liquid natural refrigerant permitted to enter the heat exchanger is equal to the amount of liquid natural refrigerant that is converted to gaseous natural refrigerant by the heat exchanger.

14. The cooling method according to claim 11, wherein the increasing the first temperature and the first pressure of the gaseous natural refrigerant is done by passing the gaseous natural refrigerant through a compressor.

15. The cooling method according to claim 14, wherein the compressor comprises a multi-stage centrifugal compressor.

16. The cooling method according to claim 11, wherein the membrane includes a plurality of pores that permit the gaseous natural refrigerant to pass through the membrane while preventing or at least minimizing the air of the external ambient environment from passing through the membrane.

17. The cooling method according to claim 16, wherein the pores are sized to be less than a molecular size of nitrogen gas.

18. The cooling method according to claim 16, wherein the membrane is formed of a polymeric material.

* * * * *